United States Patent [19]

Schaaf et al.

[11] 4,387,491

[45] Jun. 14, 1983

[54] BURIAL ENCLOSURE ARRANGEMENT AND METHOD

[76] Inventors: Cecil F. Schaaf; Craig R. Schaaf, both of 3015 Palmer Rd., Standish, Mich. 48658; James E. Van Linden; Kirk S. Van Linden, both of 3384 Michelle Ct., Clio, Mich. 48420

[21] Appl. No.: 288,630

[22] Filed: Jul. 30, 1981

Related U.S. Application Data

[63] Continuation-in-part of Ser. No. 133,345, Mar. 24, 1980, abandoned.

[51] Int. Cl.[3] ..... A61G 17/00

[52] U.S. Cl. ..... 27/35; 52/140

[58] Field of Search ..... 27/2, 1, 7, 35; 52/128, 52/129, 140, 135

[56] References Cited

U.S. PATENT DOCUMENTS

| | | | |
|---|---|---|---|
| 680,766 | 8/1901 | Crigler | 27/35 |
| 843,314 | 2/1907 | Waters | 27/35 |
| 1,024,527 | 4/1912 | Searle | 27/35 |
| 1,137,696 | 4/1915 | Campbell | 27/7 |
| 2,090,844 | 8/1937 | Kirby | 52/129 |
| 3,206,900 | 9/1965 | Doyle et al. | 52/128 |

*Primary Examiner*—John D. Yasko

*Attorney, Agent, or Firm*—Cullen, Sloman, Cantor, Grauer, Scott & Rutherford

[57] ABSTRACT

A container, which may be a burial casket or a toxic waste container, is protectively sealed by enclosing it in an initially open-topped receptacle, which may be a burial vault or similar outer container or a grave, spacing the container from the bottom of the receptacle, partially filling the receptacle with a foamable plastic still in its liquid form, and, following completion of the foaming of such initial charge, supplying sufficient additional foamable plastic in one or more additional steps to completely cover and surround the container with the resulting plastic foam. In the preferred method, a film-like plastic sheet is placed over the open-topped receptacle after the final charge of liquid foamable plastic is applied, and held in place around the edges of the opening by a collar which permits the sheet to yield upwardly as the foam expands, thereby partially confining the expanding foam to assure full filling of all voids in the receptacle. Fine-grained perlite is preferably mixed with the liquid foamable plastic to improve its properties.

3 Claims, 2 Drawing Figures

BURIAL ENCLOSURE ARRANGEMENT AND METHOD

RELATED APPLICATION

This application is a continuation-in-part of Ser. No. 133,345 filed Mar. 24, 1980 now abandoned.

BACKGROUND OF THE INVENTION

This application relates to an improved method for protectively sealing a burial casket or other containers intended to be buried.

Historically, various means have been employed to preserve the remains of man. Modern modes of burial include the use of different types of caskets and vaults for enclosing the caskets, in an effort to prevent damage to a casket and its contents for as long as possible. One of the drawbacks of a typical burial vault arrangement is the presence of an air void between the exterior of the casket and the interior of the vault.

Various attempts have been made to provide a waterproof seal, which is also resistant to other forms of invasion, for a burial casket by placing materials in the air void between the casket and the vault such as asphalt coating, concrete, plastic liners, steel, copper and so on. Exemplary of prior art techniques are the disclosures of U.S. Pat. Nos. 680,766, 843,314, 1,024,527, 1,377,656, 1,491,597, 1,502,217 and 3,206,900.

Such attempts to overcome the drawbacks of the air void within the vault have been both ineffective and expensive. Among the problems not adequately or conveniently overcome by the prior art are floatation of the casket resulting from the bouyancy of the air void-filling liquid, the presence of joints where leakage can occur, difficulty of use in inclement weather conditions or unfavorable ground conditions and excessive processing time.

In the context of toxic, corrosive or other types of hazardous waste disposal, there are additional complicating factors such as corrosion of the container by the contents as well as by the environment, crushing or bursting forces from the weight of land fill or vehicles at the land fill site, and rough handling during the dumping and burial operations.

It is therefore an object of the present invention to provide means for filling the air void within a burial vault so that leakage into the casket cannot occur.

It is a further object of the present invention to provide means for effectively sealing a casket which is not placed inside a vault to obtain a similarly satisfactory seal.

It is another object of the present invention to provide a process for effectively and securely sealing a hazardous waste disposal container, capable of surviving rough handling and other destructive forces.

Other objects and advantages of the invention will become apparent upon reading the following detailed description and upon reference to the drawings.

DETAILED DESCRIPTION OF THE INVENTION

Figure 1:
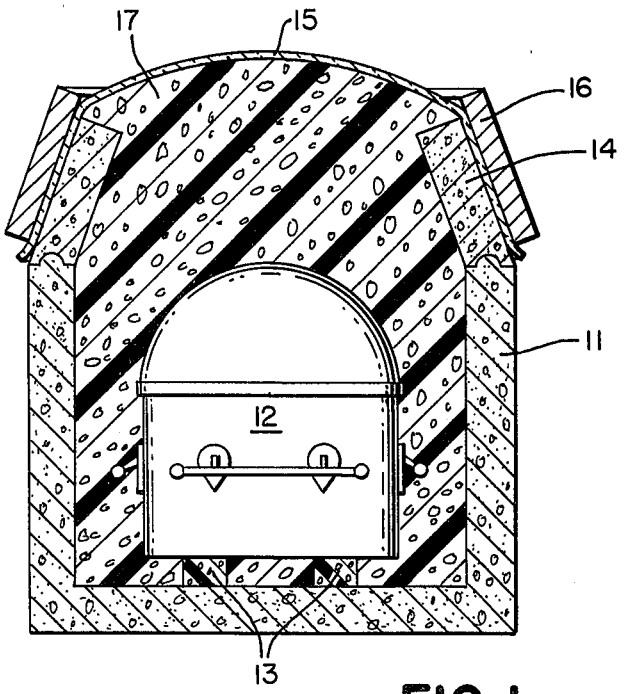
FIG. 1 is an end cross sectional view of a vault and casket therein, with the foamed plastic filler in its final condition.

While the invention is susceptible to various modifications and alternative forms, certain illustrative embodiments have been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

In accordance with present typical burial practices, a burial casket is placed within a vault, and the combination is buried in the ground. The vault may be of concrete, metal or even plastic and is used to hold the earth above the casket after burial. The illustrative vault shown in FIG. 1 is a concrete vault of the top seal type, but here used without the usual lid or top.

In accordance with the invention an improved means for sealing a burial casket within a vault is provided by encasing the casket substantially completely in a foamed plastic material. The foamed plastic serves as a filler surrounding the casket within the normally air-filled void within the vault around the outside of the casket. Preferred foamed plastic materials for this filler are substantially water proof, inexpensive, resistant to decomposition, and impervious to such things as insects and worms in the ground. Commonly available foamed plastic materials meeting these criteria include types of urea formaldehyde (UF) and polyurethane (PU) foams.

The gas phase of foamed plastic materials is generally distributed in voids known as cells, which may be either inter-connected in a manner such that gas may pass from one cell to another or in which the cells are discrete and the gas phase of each cell is independent of that of the other cells. The former type of cellular structure is referred to as open celled, and the latter form is termed closed celled. For the present purpose, it has been found that a seventy percent closed cell foamed plastic material is sufficiently water proof to serve as a sealer for a burial casket.

Foamed plastic materials typically reach the cellular state through a foaming or expanding process. This process involves creating small cells in a fluid phase of the material, causing these cells to grow to a desired size, and stabilizing the cellular structure of the material. The present examples will be described in regard to a polyurethane foam using a chemical stabilization process. The details of the chemical and physical aspects of the polyurethane foam process are well known, and since an explanation of the details of the foaming process is not critical to the present invention, a detailed explanation will not be given herein.

It may be stated briefly that the ingredients of a polyurethane foam system are a polyfunctional isocyanate and a hydroxyl-containing polymer, together with the necessary catalyst to control the reaction as well as certain other additives for controlling the surface chemistry of the process. While one-component, water reactive, polyurethane foams are available, it is preferred in the practice of the present invention to use a two-part system. There are difficulties in using a one-component foamed plastic material since the foam then requires moisture from the air in order to harden. There are difficulties in using such foams in a vault or container that seals the foam from the moisture in the outside air.

It has been found that the properties of the foam are improved by the addition of five percent by volume (relative to the liquid foamable plastic) of fine perlite. Perlite is a commercially available product consisting of froth-like particles of acidic volcanic glass. It is available in varying degrees of fineness, but the preferred type is the finest particle size, such as is used for texturizing paint. It is not only a less expensive filler, but seems to decrease cell size, increase compression and tensile strength, and improve the pouring characteristics of the liquid foamable plastic. Higher concentrations increase viscosity, volume and strength, but reduce the thoroughness of coverage and filling of small voids in tight spaces.

In order to seal a burial casket in a vault, it is necessary to place the foam beneath, around and above the casket so that there are no voids. With reference to FIG. 1, showing a top seal vault 11 containing a casket 12, the casket is placed on blocks 13, which are preferably also formed of a foamed plastic material or other corrosion resistant material and may be of the same type as that used for the filler material. The casket is placed on the blocks 13 in order to hold it above the bottom of the vault 11 so that the filler material may form a seal around all sides of the casket 12 including its bottom and to bond the casket to the vault, for reasons to be explained below.

In order to determine the amount of foamed plastic filler material to use, the volume of the interior of the vault 11, including that of extensions 14 but excluding the volume of the casket 12, is determined. Depending upon the degree of expansion of the foamed plastic material from its liquid state to its foamed state, the appropriate amount of liquid foamed plastic material is prepared. For example, for a foam having a two and one half times expansion, a total volume of foam in its liquid state equalling forty percent of the void to be filled would be prepared.

Initially, approximately one third to one half of the foamed plastic material is mixed and poured around the sides of the casket so that it runs down to the bottom of the vault. The proportion is selected which will assure that there will be no tendency of the casket to become bouyant in the relatively dense liquid state of the foamable plastic. Accordingly, the volume of liquid displaced by the casket during this initial pour must be kept low.

This initial liquid pour will begin to foam along the bottom and sides of the casket, generally in a matter of a few minutes, depending upon the type of foam used. As the foam engages the surfaces of the vault and casket and sets, it forms a secure bond thereto. The foam state of the plastic has a low enough density to avoid any tendency to float the casket. Furthermore, the cured foam will anchor the casket to the vault, and will prevent any floatation tendency created by subsequent pours of liquid foamable plastic. The foam sets in about three to five minutes.

Once the first pour of liquid material has foamed and set, a second batch of foamable material may be prepared and poured over the top of the casket and the already set foam. Whether a total of two or three pourings will be preferred will depend upon such factors as the operator's ability to estimate the quantity of liquid required, the completeness of coverage achieved, the importance of the time factor and so forth.

In the preferred embodiment, a form means is employed for the second and any subsequent pourings of the liquid foamable material. The form means comprises an inwardly converging upper extension 14, dimensioned to fit onto and interlock with the entire upper periphery of vault base 11, a thin preferably transparent plastic sheet 15, such as Saran Wrap or Visqene, and an inwardly converging retention collar 16. The latter two components are put in place promptly after the final pouring has been made, and function to yieldably confine the rising foam to assure that the foam, which tends to rise vertically more than spread laterally, will spread over the top of casket 12 and also fill all crevices and voids. Sheet 15 is free to rise in response to upward pressure of the foam, because collar 16 only loosely holds down the edges of the loosely draped sheet 15 against extension 14 by gravity and friction, allowing such edges to slide upwardly as necessary. The nature of the plastic sheet tends to produce wrinkles in its surface as it shifts position, and such wrinkles establish downward escape paths for air pockets or gaseous byproducts of the foaming process. The use of a transparent plastic sheet permits visual inspection during the final phases of the foaming operation, to assure proper expansion and coverage. When the process is complete, the foam 17 has bonded to extension 14 and sheet 15, which therefore become part of the final enclosure. Retention collar 16 is generally freely removable.

Thus, foam 17 itself forms the major structural element at the top of the casket enclosure, replacing the conventional lid or top of the vault. Experience has shown that if a foaming operation is attempted within the confines of a vault and a securely fastened vault lid, there is a strong likelihood that the expanding foam will crack the lid or crush the casket.

The foaming operation can be performed before or after the casket and vault have been placed in the open grave. Advantageously, the foaming process is essentially unaffected by weather conditions at the time of foaming.

The process of the present invention results in a completely joint-free foam enclosure for the casket. The interface of the foam volumes formed by separate pouring steps is strongly bonded together and is essentially homogeneous and continuous, and presents no potential leakage path or line of structural weakness.

As an alternative to the use of a vault to partially enclose the casket, as described above, the casket may be placed on spacer blocks directly at the bottom of the grave, and the above-described multi-step foaming process followed to fill the remaining volume of the grave itself with foam. The foam will initially bond the casket to the side walls of the grave to prevent any tendency of the liquid foaming material to float the casket off the bottom spacers. Thus, the process contemplates foaming the air space between the inner container (e.g., casket or hazardous waste container) and an outer receptacle (e.g., a vault or other open-topped container or the grave itself).

In order to maintain the casket 12 with its encasing layer of foamed plastic material 17 within the ground, such as in the case of flooding, two means of anchoring the foamed plastic-casket combination may be employed, either separately or in combination. One means for anchoring the casket is to insert a spirally threaded ground anchor into the earth beneath the grave opening prior to placing the casket into the grave opening. The anchor includes a hook portion extending upwardly into the grave opening but below the level of the casket bottom. After the casket is placed onto the spacer blocks, a cable is secured about the casket and engaged by the hook portion of the anchor. Any subsequent upward forces on the casket-foamed plastic combination, such as forces of buoyancy in the event of flooding, will be resisted by the anchored cable wrapped around the casket.

The other anchoring means which, as indicated, may be used in addition to or instead of the anchor, includes preparing the grave opening so that it is wider at the bottom than at the top. Pouring the foamed plastic material results in a tapered casket sealer layer 17 conforming to the sides of the grave opening. In the event of upward forces, the tapered foamed plastic material, surrounding the casket 12 and holding it in place, will be prevented from rising due to the wedging action between the foamed plastic material 17 and the similarly tapered sidewalls of the grave opening. The exact taper of the sidewalls of the grave opening, or the exact shape of the sidewalls in producing a cross section which is substantially wider at the bottom than at the top, is not critical to the anchoring means. Various shapes of grave opening side wall cross-sections may be utilized to obtain the anchoring action. Each of the above-described anchoring techniques can also be used, if necessary, where a vault is employed to partially enclose the casket.

While certain embodiments have been described herein with reference to a vault enclosure for a burial casket, the interiors of other casket enclosures may also be filled with a foamed plastic material as described herein. For example, any outside burial receptacles such as wood and concrete rough boxes may serve in place of the described vault. Voids may similarly be filled within cremation vaults, for urns, status crypts, lawn crypts and mausoleum crypts.

Figure 2:
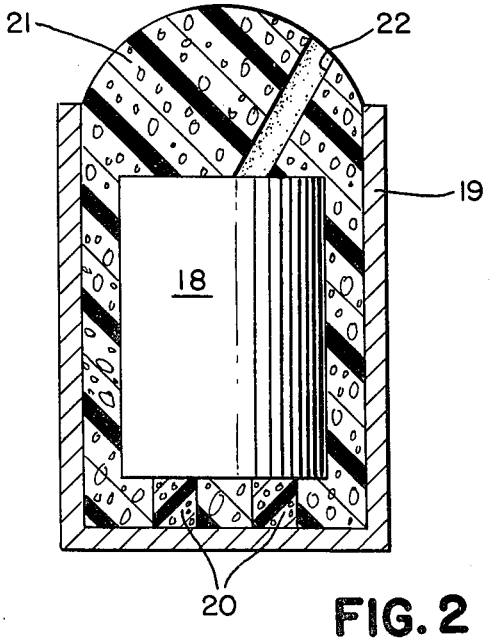
FIG. 2 is a cross-sectional elevation showing a hazardous waste disposal container to which the protective foaming process of the present application has been applied.

FIG 2. illustrates an adaptation of the method of the present invention to the protective encapsulation of a hazardous waste container 18. The container is placed on spacer blocks (preferably an oxidation resistant material such as foamed plastic or wood within open-topped outer shell 19. Then, the multiple step pouring of the liquid foamable plastic material, as described above, is performed, resulting in the formation of foam filler and enclosing top 21. The use of the upper extension 14, sheet 15 and collar 16, described with reference to FIG. 1, is optional, being less beneficial in the hazardous waste disposal application because no esthetic considerations are present. The irregular or dome-shaped contour of the top portion of foam filler 21 is preferred, to discourage stacking of such containers and the resulting possibly excessive crushing loads.

The foaming operation in connection with the embodiment of FIG. 2 can be performed either before or after the filling of container 18 with the hazardous material. Preferably, foaming is performed before filling, so that the substantially increased protection afforded by shell 19 and foam 21 will be available during all the handling and transporting phases of the disposal and burial operations. If the pre-foaming sequence is followed, a filling hole 22 is bored or punched through the foam and into the top of container 18, so that the hazardous material can subsequently poured in. Thereafter, a stopper or plug is wedged into the hole in container 18 and then a small quantity of additional liquid foamable plastic can be poured into hole 22 to fill the hole with sealing foam.

We claim:

1. An improved method for protectively sealing and enclosing a substantially closed container within an initially open-topped outer receptacle having sides which extend above the top of the enclosed container to prevent leakage of the contents of the container to the exterior of the receptacle or infiltration of outside elements into the container, comprising the steps of:

supporting the substantially closed container within the receptacle so that substantially all of the lower surface of the container is spaced from the bottom of the receptacle and so that the container is laterally spaced from the side enclosing walls of the receptacle;

partially filling the open-topped receptacle with a foamable plastic material in liquid form, the volume of liquid being insufficient to cause floatation of the container within the receptacle unit but sufficient so that the resulting foam will contact the lower portion of the container and anchor it to the interior of the receptacle as a result of the bond which is formed at the foam-to-receptacle and foam-to-container interfaces;

after the first foaming has at least substantially set, applying at least one additional pouring of foamable plastic material in liquid form to the interior of the still-open-topped receptacle, the volume of said additional application being sufficient so that the resulting foam will completely cover and enclose the container, thereby eliminating all air space immediately adjacent the exterior of the substantially closed container.

2. The method of claim 1 which further comprises the steps of:

covering the open-topped receptacle with a yieldable and flexible non-porous covering immediately after the application of the final quantity of liquid plastic foaming material;

yieldably securing said covering to the periphery of the top opening of the receptacle to permit said covering to yield upwardly as the form expands, while retaining at least a partial seal around the edges of the receptacle opening so that said covering permits the foam to expand upwardly while yieldably confining it so that the foam tends to completely cover the container and fill all cavities within the receptacle.

3. The method of claim 1 in which fine-grained perlite is mixed with the liquid foamable plastic material prior to pouring.

* * * * *